US005362031A

United States Patent [19]

Heilmann et al.

[11] Patent Number: 5,362,031

[45] Date of Patent: Nov. 8, 1994

[54] METHOD AND APPARATUS FOR THE AUTOMATIC MONITORING OF OPERATING SAFETY AND FOR CONTROLLING THE PROGRESS OF THE PROCESS IN A VACUUM HEAT-TREATMENT OVEN

[75] Inventors: Paul Heilmann, Maintal; Peter Minarski, Rodenbach; Friedrich Preisser, Buedingen, all of Germany

[73] Assignee: Leybold Durfrrit GmbH, Hanau, Germany

[21] Appl. No.: 44,300

[22] Filed: Apr. 7, 1993

Related U.S. Application Data

[62] Division of Ser. No. 773,363, Oct. 7, 1991, Pat. No. 5,225,142.

[30] Foreign Application Priority Data

Jun. 27, 1991 [DE] Germany ..... 4121277

[51] Int. Cl.[5] ..... C21D 1/773

[52] U.S. Cl. ..... 266/89; 266/90; 266/252

[58] Field of Search ..... 266/44, 89, 90, 250, 266/252

[56] References Cited

U.S. PATENT DOCUMENTS

| | | | |
|---|---|---|---|
| 4,009,872 | 3/1977 | McCoy | 266/250 |
| 4,124,199 | 11/1978 | Jones et al. | 266/88 |
| 4,191,598 | 3/1980 | Conybear et al. | 266/44 |
| 4,195,820 | 4/1980 | Berg | 266/87 |
| 4,610,435 | 9/1986 | Pfau et al. | 266/250 |
| 4,643,402 | 2/1987 | Brahmbbatt | 266/82 |
| 4,781,358 | 11/1988 | Langan | 266/89 |
| 5,035,611 | 7/1991 | Neubecker et al. | 432/176 |

FOREIGN PATENT DOCUMENTS

| | | |
|---|---|---|
| 0355520 | 2/1990 | European Pat. Off. . |
| 2595801 | 9/1987 | France . |
| 2844843 | 4/1980 | Germany . |
| 3910234 | 4/1990 | Germany . |
| 2221289 | 1/1990 | United Kingdom . |

OTHER PUBLICATIONS

CH-Z: Pock, Ernst: Luft im Ofen unerwünscht. In: Technische Rundschau Feb., 1990, S.28-33.

*Primary Examiner*—Scott Kastler
*Attorney, Agent, or Firm*—Felfe & Lynch

[57] ABSTRACT

In a vacuum heat treating oven operating with hydrogen under pressure as the cooling medium, especially for the quenching of greatly heated metal workpieces (5), a method is provided for the automatic control of the progress of the process and for monitoring safety of operation. The housing (4) of the heat treating oven is for this purpose connected to gas inlet lines (9 and 10), one for the admission of the cooling gas and one for the admission of the flushing gas ($H_2$ and $N_2$, respectively), and also to a vacuum line (17) and to a gas outlet line (11) into each of which gas sensors (24, 39, 42) are inserted, which during the quenching process signal the gas concentration to a central processing unit (41) which also is connected to pressure sensors (19, 20) and a gas sensor (21) which issue additional signals concerning the gas pressures prevailing in each instant in the interior of the housing (4) or gas inlet line (10) and concerning the gas concentration in the environment of the oven to the central processing unit (41), which then in turn, according to preset programs, actuates the gas inlet and gas outlet valves (25, 30, and 18, 28, respectively) and turns on or off the motor-blower unit (12, 13) and the heating unit (15, 15*a*, . . . ).

10 Claims, 3 Drawing Sheets

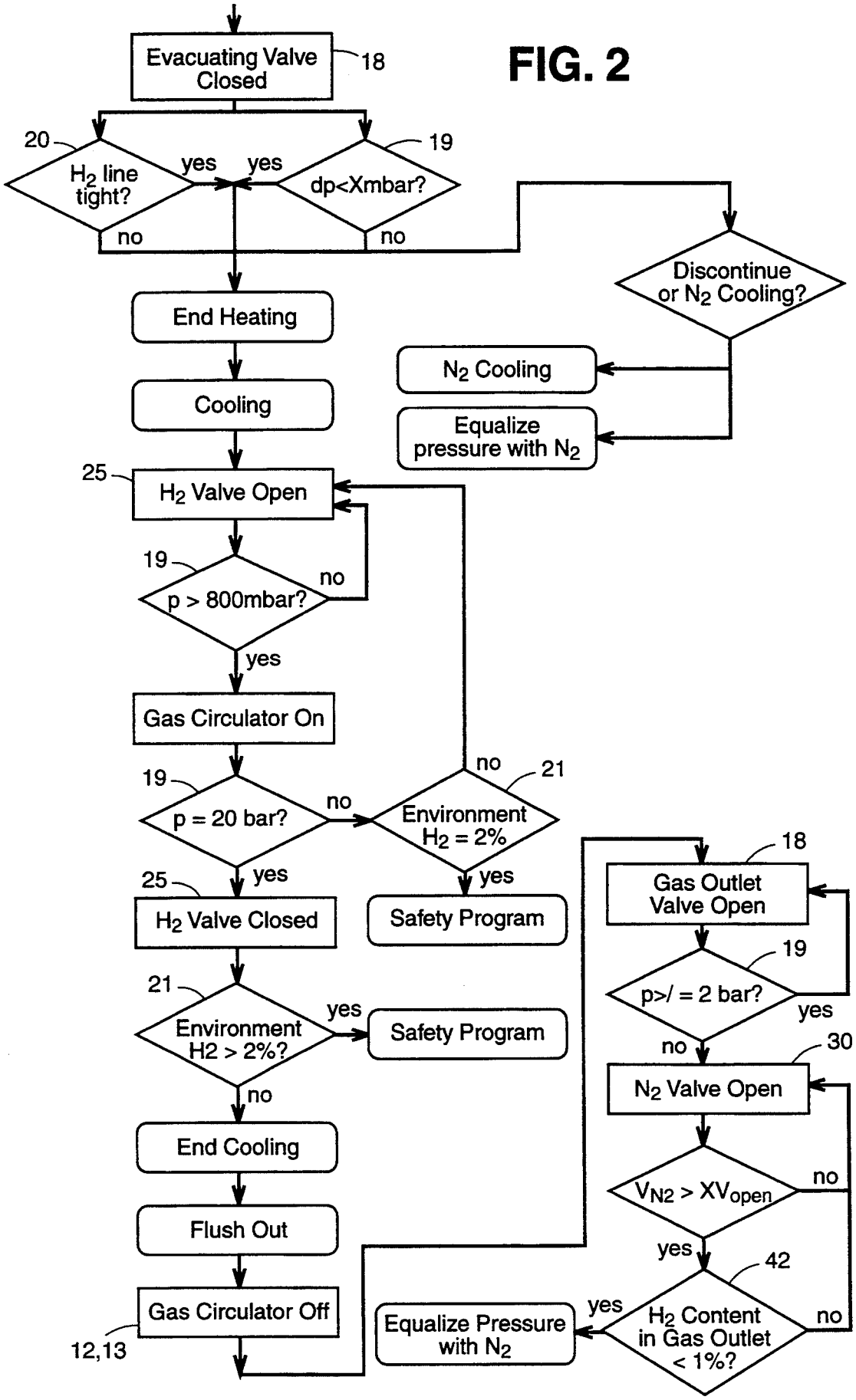
FIG. 2
Evacuating Valve Closed
18
20
$H_2$ line tight?
yes
yes
19
dp<Xmbar?
no
no
Discontinue or $N_2$ Cooling?
End Heating
$N_2$ Cooling
Cooling
Equalize pressure with $N_2$
25
$H_2$ Valve Open
19
p > 800mbar?
no
yes
Gas Circulator On
19
p = 20 bar?
no
no
21
Environment $H_2$ = 2%
yes
yes
25
$H_2$ Valve Closed
Safety Program
21
Environment H2 > 2%?
yes
Safety Program
no
End Cooling
Flush Out
Gas Circulator Off
12,13
18
Gas Outlet Valve Open
19
p>/ = 2 bar?
yes
no
30
$N_2$ Valve Open
$V_{N2} > XV_{open}$
no
yes
42
$H_2$ Content in Gas Outlet < 1%?
yes
no
Equalize Pressure with $N_2$

METHOD AND APPARATUS FOR THE AUTOMATIC MONITORING OF OPERATING SAFETY AND FOR CONTROLLING THE PROGRESS OF THE PROCESS IN A VACUUM HEAT-TREATMENT OVEN

This is a divisional application of application Ser. No. 733,363, filed Oct. 7, 1991, now U.S. Pat. No. 5,225,142.

The invention relates to a method and an apparatus for the independent monitoring of operating safety and for controlling the progress of a process in a vacuum heat treating oven, especially in an oven operating with hydrogen gas under pressure as a cooling gas for hardening metal workpieces, having a housing connected to a vacuum pump and enveloping the heating chamber receiving the charge of workpieces, and having gas inlet and gas outlet openings leading into the heating chamber, a motor-blower unit whose impeller circulates the cooling gas, a cooling gas supply tank, a heating unit, and having a heat exchanger in the cooling gas circuit.

BACKGROUND OF THE INVENTION

Industrial furnaces of this kind are disclosed in German Patent 2844843. They are used especially so as to be able to harden parts of high-speed steel and other tool steels. They are also suitable, however, for other heat treatments, such as bright-annealing. Such a furnace consists of a hollow cylindrical steel housing with an opening front door which allows access to the heating chamber. The heating chamber is made from a steel jacket which is lined with a thermal insulation. On the bottom and on the roof the heating chamber is provided with a large opening for the passage of gas. These openings are closed during the heating and holding period by insulated shutters. In the cooling process cold gas which is circulated through the heating chamber flows around the charge in the heating chamber. The velocity of circulation and the degree of the recooling of the gas is controllable only by the design of the heat exchanger and blower belonging to the furnace.

A high gas velocity is what is required in order to achieve a rapid cooling of the charge. Only with a sufficiently fast heat removal is it possible to perform a hardening, for example. To achieve a rapid cooling of the charge, there exists, therefore, the need to circulate at a high velocity the quenching gas blown into the heating chamber.

The hardening of steels calls for a cooling of the workpieces from the austenitizing temperature (900° C.) to room temperature at controlled rates. According to the type of steel, a heat removal is required that can be achieved only with certain environment media. The highest cooling rates are achieved with liquids. Gases have a lower thermal conductivity. By increasing the gas pressure and the circulating power it is possible to increase the heat removal to within the range of liquids. Disadvantages of liquid quenching is uncontrolled quenching, contamination of the surface with degradation products which call for complicated cleaning, and the expensive and difficult technology that is involved if the workpieces have to be annealed in a vacuum.

Gas quenching is usually performed with nitrogen gas, which except for helium and hydrogen produces the best heat removal. When nitrogen is used it is possible to raise the pressure to as much as 10 bar. With helium a further increase to 20 bar is possible. However, when these inert gases are used contamination in the oven is increased to a multiple of the pressure. Any further increase in the cooling ram in the gas is possible only by using hydrogen as the thermal transfer medium, since hydrogen has the highest thermal conductivity of all the gases, and also, due to its low density, it can be circulated with low power. With this gas all workpieces which heretofore have been quenched in liquids could be quenched in gas. An additional important advantage is the possibility of performing this quenching controlledly, which is not possible in liquids on account of Leidenfrost's phenomenon. Despite these evident advantages, high-pressure hydrogen quenching has not been achieved heretofore since the use of hydrogen at high pressure constitutes a considerable safety hazard.

It is therefore the object of the present invention to make safe practice of the process possible by a rational combination of known units of apparatus and to provide a procedure or flow sheet according to which this hydrogen quenching can be practiced. The sequence of the individual steps is to be selected such that at no time in the process can an explosive mixture form in the apparatus, and that, if some components fail, the development of a safety hazard can reliably be prevented.

SUMMARY OF THE INVENTION

This object is achieved in accordance with the invention in that a pressure sensor measuring the pressure in the housing of the oven and at least one gas sensor disposed in the immediate environment of the oven are provided, which, in conjunction with a processing unit, if a predetermined internal pressure in the housing and a simultaneously developing gas concentration are not reached, will initiate a safety program in the environment of the oven, which will produce an immediate closing of the cooling gas inlet valve, an opening of the gas outlet valve, and an opening of a flushing gas inlet valve inserted into a line which connects the flushing gas supply tank with the interior of the oven housing, and thus finally an equalization of the pressure in the housing and environment of the oven will be brought about in accordance with the cooling gas concentration at the gas outlet valve registered by a gas sensor inserted into a by-pass of the gas outlet line.

Preferably an evacuating valve and at least one gas sensor are inserted for this purpose into the vacuum line leading from the housing of the vacuum heat treating oven to the vacuum pump, while a first pressure sensor which detects the pressure in the interior of the housing and a second pressure sensor which detects the pressure in the cooling gas inlet line are provided, and at least one gas sensor testing the oven environment in the immediate vicinity of the vacuum heat treating oven and one gas sensor inserted into the cooling gas outlet line, and, after the closing of the evacuating valve at the start of the quenching process, a first measurement of the two pressure sensors detecting the pressure in the interior of the housing and the pressure in the cooling gas inlet line either produces a discontinuation of the quenching process or else the opening of the cooling gas inlet valve, until the pressure in the housing has reached a prescribed level (e.g., $p=20$ bar) which is sensed by the first pressure sensor, or else leads to the discontinuation of the current quenching process if the gas sensor detecting the gas concentration in the environment fails to detect a given level (e.g., $H_2>2\%$), and lastly, after the closing of the cooling gas inlet valve and after a permissible gas concentration (e.g., $H_2>2\%$) in the oven environment, the quenching process is terminated, and, after the relieving of the pressure in the housing by opening the cooling gas outlet valve, a filling of the housing with flushing gas (e.g., $N_2$) is performed by opening the flushing gas inlet valve, until the cooling gas concentration detected at the gas outlet by the gas sensor has become uncritical (e.g., $H_2$ content $<1$).

Advantageously, an evacuating valve inserted into the vacuum line between vacuum pump and housing simultaneously cooperates with a cooling gas outlet valve inserted into the cooling gas inlet line and a first pressure sensor measuring the pressure in the interior of the housing, and, when the evacuating valve is closed, produces, at a given housing pressure and simultaneously closed cooling gas inlet valve, the signal for cutting off the heating unit followed by the opening of the cooling gas inlet valve and, in accordance with the pressure rise in the housing and/or the reduction of pressure in the feed line, permits the safety-flushing of the housing with flushing gas followed by the subsequent pressure equalization of the housing, while, with the cooling gas inlet valve opened, the pressure sensor, after a predetermined initial cooling gas pressure is reached, activates the blower for the cooling gas circulation, while the sensor for the housing interior pressure, only after a predetermined working pressure is reached in the housing, keeps the cooling gas circulation running until the desired quenching temperature is reached, and, when a rise in the cooling gas concentration in the environment of the heat treatment oven to a predetermined level is detected by a sensor, activates a safety program which begins with the closing of the cooling gas inlet valve and the opening of the gas outlet valve, and continues to run with a subsequent complete flooding of the housing with flushing gas, until the cooling gas content in the area of the gas outlet valve has dropped to a permissible value, which then leads to the closing of the flushing gas valve followed by pressure equalization with flushing gas down to the atmospheric pressure, and finally, after testing the cooling gas concentration at the gas outlet by means of the gas sensor inserted into the by-pass line for a predetermined level, leads to the equalization of pressure between the interior of the housing and the ambient air.

Additional features and details of the invention are further described and identified in the claims.

BRIEF DESCRIPTION OF THE DRAWINGS

The invention admits of a great variety of embodiments; one of them is depicted in the appended drawings, wherein:

FIG. 2 is a flow diagram of the quenching process.

DESCRIPTION OF A PREFERRED EMBODIMENT

Figure 1:
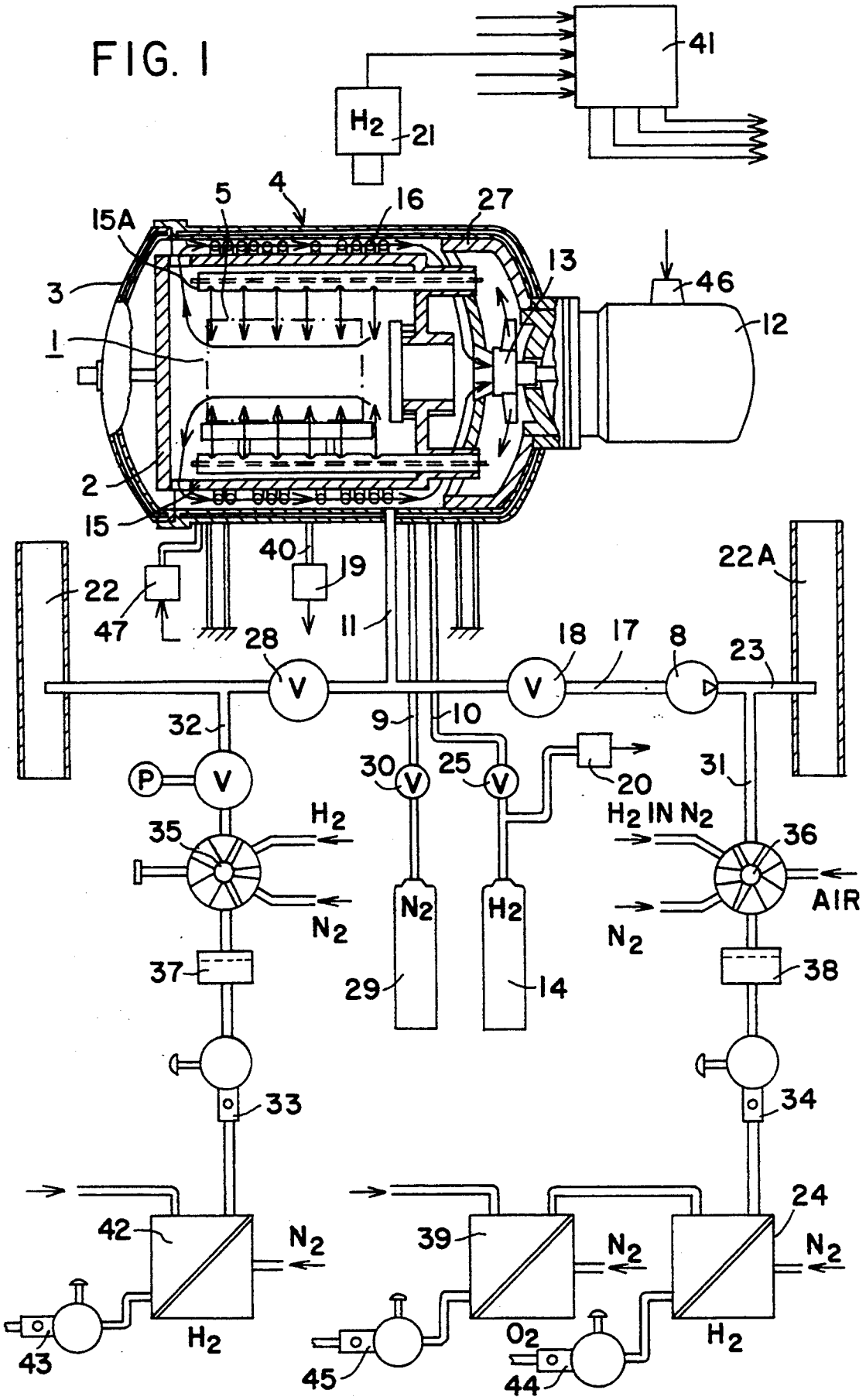
FIG. 1 is a greatly simplified and purely diagrammatic section taken through the vacuum heat treating oven and the units combined with it.

The vacuum heat treating oven consists essentially of a hollow cylindrical housing 4 whose one end wall can be closed with a cover 3, a blower motor 12 with blower wheel 13 disposed on the other end wall of the housing 4, a hollow cylindrical charge chamber 2 disposed in the housing interior, with a charge basket 1 which can be inserted therein and into which the workpieces 5 can be placed for treatment, a plurality of heating tubes 15, 15*a*, . . . , running directly adjacent to the charge basket 1, parallel to the longitudinal axis of the housing, a blower housing 27 provided between the blower motor 12 and the charge basket 1 in the interior of the housing 4, and a heat exchanger 16 contained in the annular space between the inner wall of the housing 4 and the outer wall of the charge chamber 2 and consisting of a coil of tubing through which a coolant flows.

The heat treating oven is connected by a vacuum line 17 to a vacuum pump 8 whose discharge connection 23 leads into the flue 22*a*; the vacuum line 17 can be shut off by an evacuating valve 18. The vacuum line 17 is connected to the gas outlet 11 which can be shut off by a gas outlet valve 28 and which leads into the flue 22. The inlet lines 9 and 10, which are connected to the gas tanks 14 and 29 and into which valves 25 and 30 are inserted whereby the two lines 9 and 10 can be shut off, lead into the hollow cylindrical housing 4. Both the vacuum line 17 and the gas outlet line 11 are in communication via branch lines 31 and 32 with electrical testing and processing units and their gas sensors 24, 42 and 45 through which the gas concentrations in the two lines 11 and 17 can be detected and processed to the corresponding electrical control pulses and control signals, which can be compared in a central control unit or computer 41 with a previously installed program.

It is also to be noted that into these two branch lines there are also inserted flow monitors 33 and 34, test gas cocks 35 and 36 and membrane filters 37 and 38, by means of which the processing units 24 and 42 or additional series-connected processing units 39, . . . , sensitive to other kinds of gas (such as oxygen for example) can be adjusted precisely to the progress of the process.

To enable the internal pressure of the hollow cylindrical housing 4 to be measured, the housing 4 is connected by a test line 40 to a pressure sensor 19. Lastly, a gas sensor 21 is disposed in the direct vicinity of the housing 4 and permits the cooling gas concentration in the oven environment to be tested, which can then be processed in the central processing unit 41 to form the corresponding electrical signals.

The vacuum heat treating oven described above is suitable especially for the hardening of workpieces 5 of steel in a hydrogen atmosphere at a pressure of 40 bar, for example. In order to assure the necessary safety of operation when dealing with hydrogen, the procedure represented in FIG. 2 is provided, wherein the individual process steps take place automatically in relation to the values detected by the gas sensors 21, 24 and 39 and the pressure sensors 19 and 20.

As the flow diagram in FIG. 2 shows, the actual quenching process (hardening process) begins with the closing of the evacuating valve 18 and after the heating of the charge 7 by the heating units 15, 15*a*, . . . , after a predetermined vacuum has been established in the housing 4. It is clear that, during this phase, valves 28, 25 and 30 must also be closed. After the evacuating valve 18 has been closed, first it is determined whether the cooling gas line 10 is not leaking, i.e., the pressure at the pressure sensor 20 must remain constant; at the same time, the pressure in housing 4 must not have fallen below the predetermined value ($dp<x$ mbar). Only if both conditions are fulfilled is the heating current shut off by the diagrammatically represented central unit 41, and the quenching process is started by opening the cooling gas inlet valve 25. After the predetermined pressure $p<800$ mbar is reached, the blower motor 12 is started and causes the cooling gas to circulate in the direction of the arrow, through the housing and the blower housing 27, the charge 7, the heating tubes 15, 15*a*, . . . , and the heat exchanger 16 which is formed by tubes through which cold water is flowing. At the same time the pressure in housing 4 is increased to, for example, p=20 bar (or even to a prescribed 40 bar) and the gas concentration in the environment of the oven is monitored by means of the gas sensor 21. After the housing pressure of p=20 bar is reached, the cooling gas inlet valve 25 is closed and the charge is cooled by the circulation of the cooling gas.

After the cooling the blower motor 12 is shut off and then the gas outlet valve 28 is opened in order to carry the gas through the gas outlet 11 into the exhaust flue 22, which is flushed anyway during the entire process by the flushing gas (preferably nitrogen) in order to make sure that at no point can a critical mixture of oxygen and hydrogen form in it. As soon as the pressure in the interior of the housing 4 has fallen to $p>=2$ bar, the flushing gas valve 30 is opened so that the flushing gas (preferably nitrogen) can flow from the supply tank 29 through the gas inlet 9 into the housing 4 until the volume reaches $N_2>x$ V and the gas concentration at the gas outlet 11 is lower than 1% and a complete equalization of pressure has been established.

Figure 3:
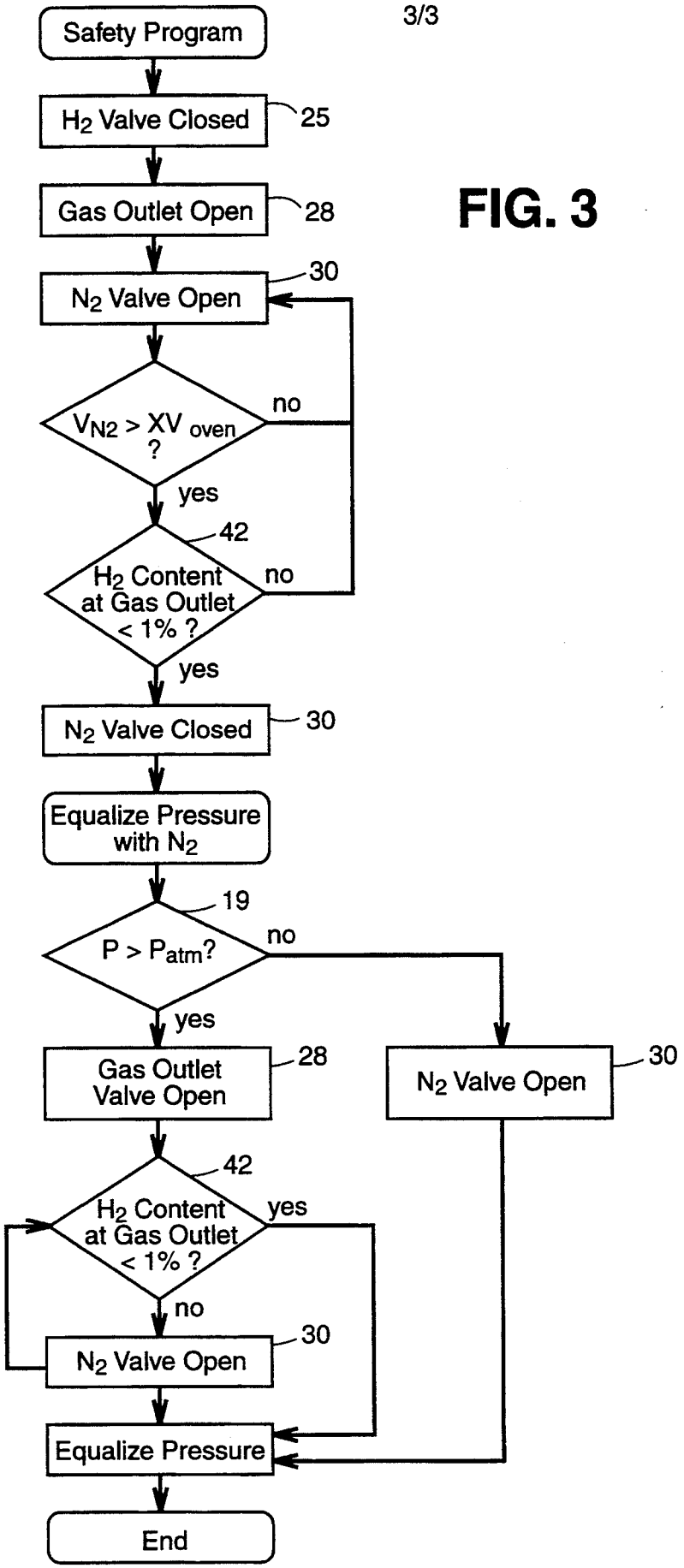
FIG. 3 is a flow diagram of the safety program.

Essential to the invention is the association of a safety program whose flow diagram is represented in FIG. 3, and by which the assurance is provided in every phase of the quenching process that, upon the occurrence of a leak in the area of the oven or in case of the collection of an explosive gas mixture in parts of the apparatus or in the environment of the oven, the process will be automatically interrupted or suspended until the danger is eliminated or resolved.

The safety program represented in FIG. 3 starts automatically when a cooling gas concentration of $H_2>2\%$ has collected in the environment of the oven, as sensed by the gas sensor 21. It begins with the immediate closing of the cooling gas inlet valve 25, the opening of the gas outlet valve 28, the opening of the flushing gas inlet valve 30. The flushing gas inlet valve 30 then remains open until the housing 4 of the oven is completely filled with the $N_2$ flushing gas and the cooling gas concentration at the gas outlet valve 28 amounts to $H_2<1\%$. In the pressure equalization with the flushing gas that then follows, the housing pressure must become p>p atm, so that the gas outlet valve 28 continues to remain open and the cooling gas concentration at the gas outlet valve 28 is also lower than 1%.

As it is apparent from the flow diagram shown in FIG. 2, after the charge or charge basket 1 has been introduced into the housing 4, and after the housing 1 has been closed, and housing 1 has been pumped down through line 17 and after the charge has been heated, the evacuating valve 18 is automatically closed upon a signal from the processing unit 41. Assuming that the desired housing pressure has been reached, and that the hydrogen line 10 is free of leakage, the heating unit 15*a*, 15*b*, . . . , is turned off and the motor blower unit 12, 13, has been turned on, then the hydrogen valve 25 is opened and hydrogen gas is admired into the housing; at the same time the pressure rise in housing 4 is controlled by means of the sensor 19 until the pressure has finally reached 20 bar. The hydrogen valve 25 is then closed and the quenching process is completed as long as the hydrogen gas concentration in the environment remains under 2%; then the flushing operation with nitrogen gas is started, and then the motor-blower unit 12, 13, is shut off and then the gas outlet valve 18 is opened until the pressure in housing 4 has completely dropped; lastly, the nitrogen valve 30 is again opened until the hydrogen gas content in the exhaust flue 22, 22*a* amounts to less than 1% and complete pressure equalization with the environment air is reached.

The safety program represented as a flow diagram in FIG. 3 and stored in the central processing unit begins with the closing of the hydrogen gas valve 25, the opening of the gas outlet 28, and the opening of the nitrogen valve 30. The nitrogen valve 30 then remains open until the hydrogen content at the gas outlet 11 is measured at less than 1% by the sensor 42; as soon as this value is reached the nitrogen valve 30 is closed and pressure equalization with nitrogen gas is performed (p>p atm); then the gas outlet valve 28 is opened until the hydrogen gas content at the gas outlet has become completely uncritical and a pressure equality with the environment air has been achieved.

We claim:

1. Apparatus for the independent monitoring of safety of operation and for controlling the progress of a process in a vacuum heat-treating oven operating with cooling gas under pressure, for the hardening of metal workpieces, with a housing enclosing the heating chamber for accommodating the charge of workpieces and connected to a vacuum pump, with gas inlet openings and gas outlet openings leading into the heating chamber, a motor blower unit whose impeller circulates the cooling gas, a cooling gas supply tank, a heating unit and with a heat exchanger in the cooling gas circuit, wherein a pressure sensor measuring the pressure in the housing of the oven, and at least one gas sensor disposed in the immediate environment of the oven are provided, each of which, in conjunction with a processing unit, upon failure to reach a given pressure in the interior of the housing and a gas concentration simultaneously establishing itself in the oven environment, initiates a safety program which produces an immediate closing of the cooling gas inlet valve, an opening of the gas outlet valve and an opening of a flushing gas inlet valve, which is inserted into a line which connects the one flushing gas tank with the interior of the oven housing and thus finally, in accordance with the cooling gas concentration at the gas outlet valve, registered by a gas sensor inserted into a branch line to the gas outlet line, produces the pressure equalization of housing interior and oven environment.

2. Apparatus for the automatic monitoring of the safety of operation and for the control of the progress of a process in a vacuum heat-treating oven operated with hydrogen gas as cooling gas under pressure for the hardening of metal workpieces, with a housing surrounding the heating chamber for the accommodation of the workpiece charge and connected to a vacuum pump, with gas inlet lines and gas outlet lines leading into the heating chamber, a motor blower unit whose impeller circulates the cooling gas stream, a cooling gas supply tank, a heating unit and with a heat exchanger in the cooling gas circuit, wherein an evacuating valve and at least one gas sensor are inserted into the vacuum line leading from the housing of the vacuum heat treating oven to the vacuum pump, and that a first pressure sensor detecting the pressure in the interior of the housing and a second pressure sensor detecting the pressure in the cooling gas inlet line are provided, and that at least one gas sensor testing the oven environment in the direct vicinity of the vacuum heat treating oven and one gas sensor inserted into the cooling gas outlet line are disposed, and, after the evacuating valve has been closed at the start of the quenching process, a first measurement of the two pressure sensors for the pressure in the interior of the housing and for the pressure in the cooling gas inlet line produces either the interruption of the quenching process or else produces the opening of the cooling gas inlet valve until the pressure in the housing has reached a given level, which is sensed by the first pressure sensor, or else leads to the interruption of the current quenching process if the gas sensor for the gas concentration in the environment fails to detect a given level, and finally, after the closing of the cooling gas inlet valve and an allowable gas concentration in the oven environment, the quenching procedure is ended and, after the housing has been relieved of pressure by opening the cooling gas outlet valve, a filling of the housing with flushing gas is performed by opening the flushing gas inlet valve, until the cooling gas concentration in the gas outlet line monitored by the gas sensor has become uncritical.

3. Apparatus according to claim 1, wherein an evacuating valve inserted into the vacuum line between vacuum pump and housing cooperates simultaneously with a cooling gas outlet valve inserted into the cooling gas inlet line and with a first pressure sensor which measures the pressure in the interior of the housing and, only if the evacuating valve is closed at a given housing pressure and simultaneously the cooling gas inlet valve is closed, gives the signal for shutting off the heating unit with subsequent opening of the cooling gas inlet valve and, depending on at least one of the pressure rise in the housing and pressure drop in the feed line, permits the safe flushing of the housing with flushing gas and the subsequent pressure equalization of the housing, while if the cooling gas inlet valve is open, the turning on of the motor blower unit for the cooling gas circulation takes place after the reaching of a predetermined cooling gas initial pressure, while the sensor for the housing's internal pressure keeps the cooling gas circulation in progress only upon the reaching of a predetermined working pressure in the housing, and in the event of an increase in the cooling gas concentration in the environment of the heat treating oven to a predetermined level, detected by a sensor, turns on a safety program which begins with the closing of the cooling gas inlet valve and the opening of the gas outlet valve and continues through a subsequent complete flooding of the housing with flushing gas, until the cooling gas content in the area of the gas outlet valve has sunk to an acceptable level, which then leads to the closing of the flushing gas valve upon subsequent pressure equalization with flushing gas down to atmospheric pressure, and finally, after checking the cooling gas concentration at the gas outlet by means of a gas sensor inserted into the branch line, leads at a predetermined level to pressure equalization between the interior of the housing and the environment air.

4. Apparatus according to claim 1, wherein the gas outlet line connected with the housing interior leads into an exhaust flue leading to the exterior, while the gas sensor testing the flushing gas concentration at the gas outlet is connected with the section of the gas outlet line which connects the gas outlet valve to the flue and the gas sensor is part of an electrically operating processing unit through which at least one of a display unit and the gas inlet valves and the gas outlet valve and the evacuating valve can be directly controlled.

5. Apparatus according to claim 1, wherein at least one gas sensor testing the gas concentration in the immediate vicinity of the housing is provided, which cooperates with a processing unit through which at least one of a display unit and an electrically operating central unit can be controlled, which in turn, for the purpose of starting a safety program, actuates the cooling gas valve and flushing gas valve and the gas outlet valve in a sequence determined by the safety program, and furthermore switches to this safety program whenever the first pressure sensor testing the internal pressure of the housing signals this processing unit that a given minimum pressure is not achievable in a given unit of time.

6. Apparatus according to claim 1, wherein an evacuating valve is inserted into the vacuum line leading from the vacuum pump to the housing of the oven, and the pump outlet leads through a vacuum connection into an exhaust flue, the vacuum connection being connected with the branch line of at least one of a cooling gas sensor and oxygen sensor which in turn is included in the control circuit of the processing unit.

7. Apparatus according to claim 1, wherein a cooling gas inlet valve is inserted into the gas line leading from the cooling gas supply tank to the housing of the oven, a pressure sensor being connected to the portion of the line between supply tank and valve, which in turn cooperates with the processing unit which in turn is connected to an additional pressure sensor which communicates through the test line with the interior of the housing of the oven, and which, after the evacuation of the housing of the oven, causes the interruption of the heat treatment process or the flooding of the housing with flushing gas from the flushing gas supply tank, or else the shutting off of the heating unit followed by the opening of the cooling gas inlet valve for the purpose of quenching the charge.

8. Apparatus according to claim 1, wherein with each of the gas sensors flow monitors are associated, which in conjunction with test gas cocks inserted into the particular branch line permit a precise tuning of the gas sensors.

9. Apparatus according to claim 1, wherein the central processing unit is in active communication on the one hand with the gas inlet valves, the gas outlet valve, the evacuating valve, the heating current switch and the blower motor switch, and on the other hand with the gas sensors and the pressure sensors such that, at levels above the set values of the gas concentration in at least one of the housing, the vacuum connection, the gas outlet or oven environment and the case of a pressure loss in the housing or the cooling gasline, a safety program can be put into action in which the cooling gas inlet valve is closed, the gas outlet valve is opened, the flushing gas inlet valve is opened and then reclosed, the gas outlet valve is reopened, and, when the permissible cooling gas concentration is reached in the gas outlet line, pressure equalization is achievable.

10. Apparatus according to claim 1, wherein the central processing unit for the purpose of the independent control of the process for quenching the charge is connected, on the one hand, both to the pressure sensor for monitoring the internal pressure of the housing and with the pressure sensor for detecting the pressure in the cooling gas line, and also, on the other hand, with the gas sensors for detecting the gas concentrations at the gas outlet and the vacuum connection and also with at least one gas sensor for detecting the gas concentration in the immediate environment of the oven and likewise with the switches for the blower motor and for the heating unit such that, after the closing of the vacuum valve the cooling gas inlet valve is opened and the motor-blower unit is started, and, after a certain housing internal pressure is reached, the cooling gas valve is reclosed and, after the quenching of the charge is concluded, the flushing gas is introduced into the housing, the motor-blower unit is turned off again, and the gas outlet valve is opened, until pressure equalization is accomplished between the environment and the housing interior.

* * * * *